United States Patent [19]

Ingram

[11] Patent Number: 4,759,819

[45] Date of Patent: Jul. 26, 1988

[54] METHOD AND APPARATUS FOR DISPENSING TAPE

[75] Inventor: Lawrence L. Ingram, Salinas, Calif.

[73] Assignee: Tanimura & Antle, Salinas, Calif.

[21] Appl. No.: 894,211

[22] Filed: Aug. 7, 1986

[51] Int. Cl.[4] ..... B26F 3/02

[52] U.S. Cl. ..... 156/443; 156/459; 156/522; 225/72

[58] Field of Search ..... 156/443, 459, 468, 475, 156/483, 522, 530, 510, 185, 186, 187, 212, 215; 225/72, 73, 74

[56] References Cited

U.S. PATENT DOCUMENTS 3,389,039 6/1968 Steckler ..... 156/468

FOREIGN PATENT DOCUMENTS 0617986 4/1961 Canada ..... 255/72

*Primary Examiner*—Michael Wityshyn

*Attorney, Agent, or Firm*—Charles E. Wills

[57] ABSTRACT

A method of taping a product and a tape dispenser. A support for a roll of tape is mounted in a frame and a lever unit is pivotally mounted in the frame. A cutter head and a tape roller are carried by the lever unit, with the tape following a path from the initial roll of tape over the roller to the cutter head, with the adhesive side of the tape exposed and away from the components of the dispenser. The cutter head is pivotally mounted on the lever unit and a linkage provides for pivoting the cutter head from a tab folding position to a cutting position as tape is pulled from the roll, over the roller and onto the product. The taped product is cut from the remainder of the tape at the cutter thereby releasing the pulling force on the lever unit which returns to its original position producing slack in the tape which is folded over to produce the desired tab.

11 Claims, 3 Drawing Sheets

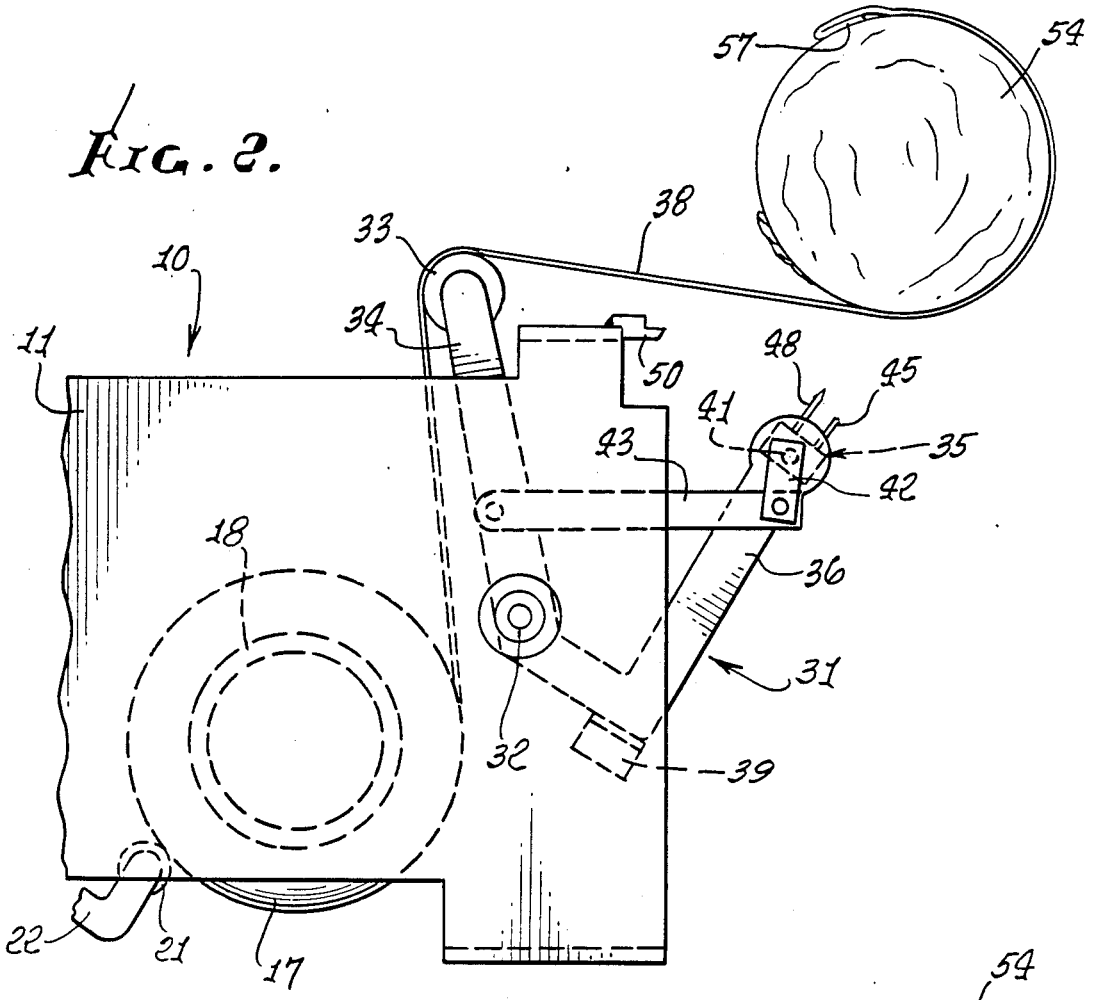
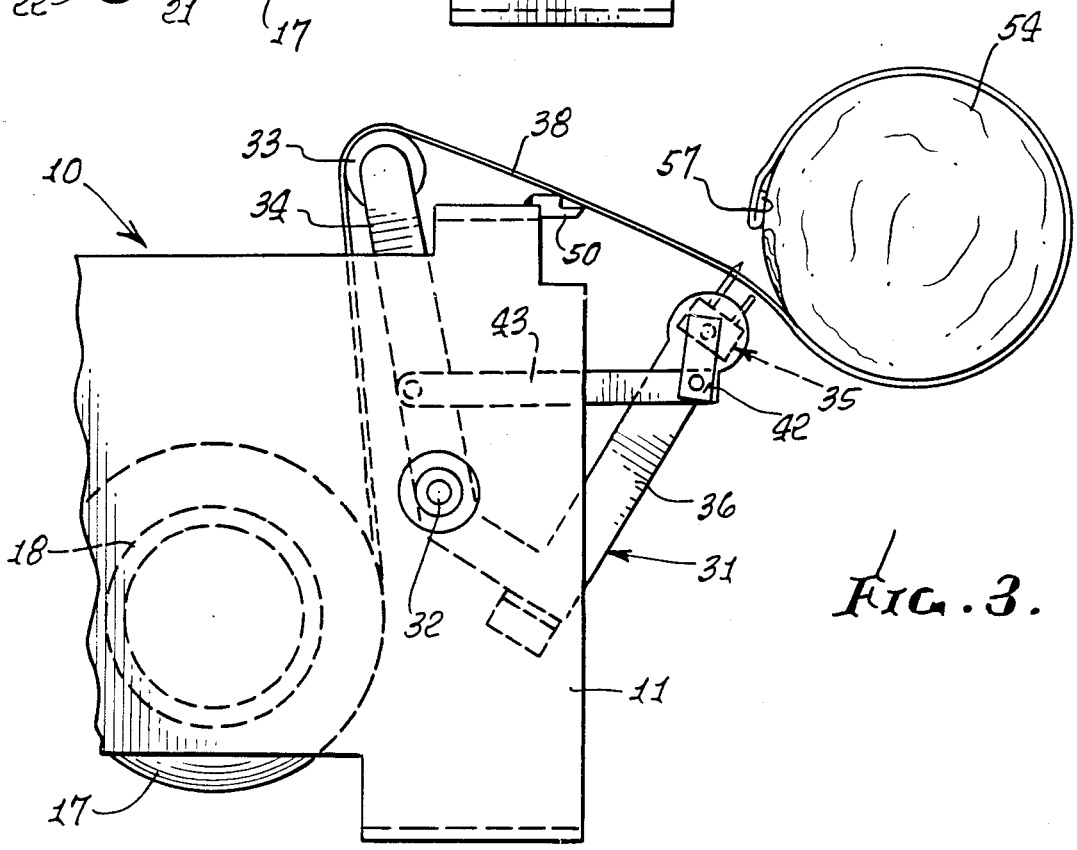
FIG. 3.

METHOD AND APPARATUS FOR DISPENSING TAPE

BACKGROUND OF THE INVENTION

This invention relates to tape dispensing and in particular, to a new and improved method and apparatus for quick and easy taping of a product in a single motion by the operator.

Adhesive tapes are utilized for a variety of purposes including packaging of products, and the present invention will be described in conjunction with the packaging of farm produce, typically heads of lettuce. However, it will be understood that the method and apparatus are equally applicable to the taping of other products and the invention is not intended to be limited to this specific use.

As an example, in a typical harvesting activity, individual heads of lettuce are packed in individual plastic bags, with each bag being twisted to close the opening. Next, a piece of adhesive tape, typically a clear plastic tape with adhesive on one side, is wrapped around the bag over the twisted closure to seal the bag. Later at the retail market, if the head of lettuce is required to be trimmed by the green grocer, it is necessary to tear open the bag, trim the head, place it in a new bag, and reseal it. Obviously, this procedure requires additional bags and is very time-consuming.

A variety of tape dispensers have been used in the past for various sealing and packaging purposes. The most common dispenser includes a holder for a roll of tape and a serrated edge affixed to the holder. The tape is pulled from the roll over the serrated edge and the tape is cut or severed by a sideways pulling motion across the serrated edge. The free end of the roll of tape is maintained in position at the cutter by having the adjesive side of the tape facing downward so that it engages the support for the cutter. However, in order to dispense another length of tape from the roll, the free end must be raised from the cutter support and then pulled from the roll as previously described.

A variation of the tape dispenser described in the preceding paragraph has a separate tab forming unit pivoted at the cutting edge, with the tab being formed by the operator pushing on the tab forming device before the desired length of tape is pulled from the roll and severed at the cutter.

Another type of tape dispenser has a support for the roll of tape and a working platform adjacent to the tape roll, with the cutting edge positioned at the end of the platform remote from the roll of tape. In this device, the tape lies across the working platform with the adhesive side facing up away from the platform. This unit is utilized by placing the product down onto the adhesive side of the tape, rolling the product and pulling tape from the roll, and then separating the tape by pulling it across the cutting edge. One problem with this configuration is that there is nothing which holds the tape in place on the platform and therefore the tape is readily displaced by a breeze or other ambient disturbance. While this device does permit use without requiring preliminary lifting of the free end of the tape from a support, the device does not form any type of tab.

Accordingly, it is an object of the present invention to provide a new and improved method and apparatus for taping a product which can be operated with one motion and which forms a tab for facilitating subsequent handling of the tape.

It is another object of the invention to provide such a method and apparatus wherein the adhesive side of the tape faces upward away from the tape dispenser permitting wrapping of a product by laying the product into the adhesive side of the tape, rolling the product and pulling tape from the supply, and cutting off the tape and with the convention downward motion, with the desired tab being formed automatically and with the dispenser holding the tape in position for the next wrap by gripping the tab.

A further object is to provide such an apparatus in which the cutting edge is shielded when in the rest or inoperative position, so as to avoid damage to the blade and increase the safety to workers.

Other objects, advantages, features and results will more fully appear in the course of the following description.

SUMMARY OF THE INVENTION

A method of taping a product with a length of tape from a tape source, including placing a product on the adhesive side of the tape and rolling the product into the tape while applying a pulling force on the tape source so as to move the product away from the source. The method further includes cutting the product wrapped tape from the remainder of the tape, terminating the pulling force, and leaving a tape end. The newly formed tape end is engaged and folded on itself to form a tab while the tape end is being moved toward the tape source.

A tape dispenser with a support for a roll of tape and a pivoting lever unit which moves between a rest position and a taping position. The lever unit has a cutter head and a tape support means, typically a roller. The adhesive tape moves along a path from the tape source over the tape support means to the cutter head with the adhesive side of the tape exposed away from the components. Tape engaging means are incorporated in the cutter which pivots between a tab forming position and a cutting position. The lever mechanism is configured so that during a taping operation, the lever unit moves toward the taping position and the cutter heads pivots into the cutting position. Cutting of the tape releases the pulling force on the tape and the lever unit moves in the opposite direction with the cutter head engaging the newly freed end of the tape, pivoting toward the tab forming position as the lever moves to the rest position, folding the free end of the tape on itself to form the tab, and engaging the tab to hold the tape in place on the dispenser.

BRIEF DESCRIPTION OF THE DRAWINGS

FIG. 2 is a partial view similar to that of FIG. 1 showing the product in the partially wrapped condition;

FIG. 3 is a partial view similar to that of FIGS. 1 and 2 showing the taped product in the ready to cut position;

DESCRIPTION OF THE PREFERRED EMBODIMENT

Figure 1:
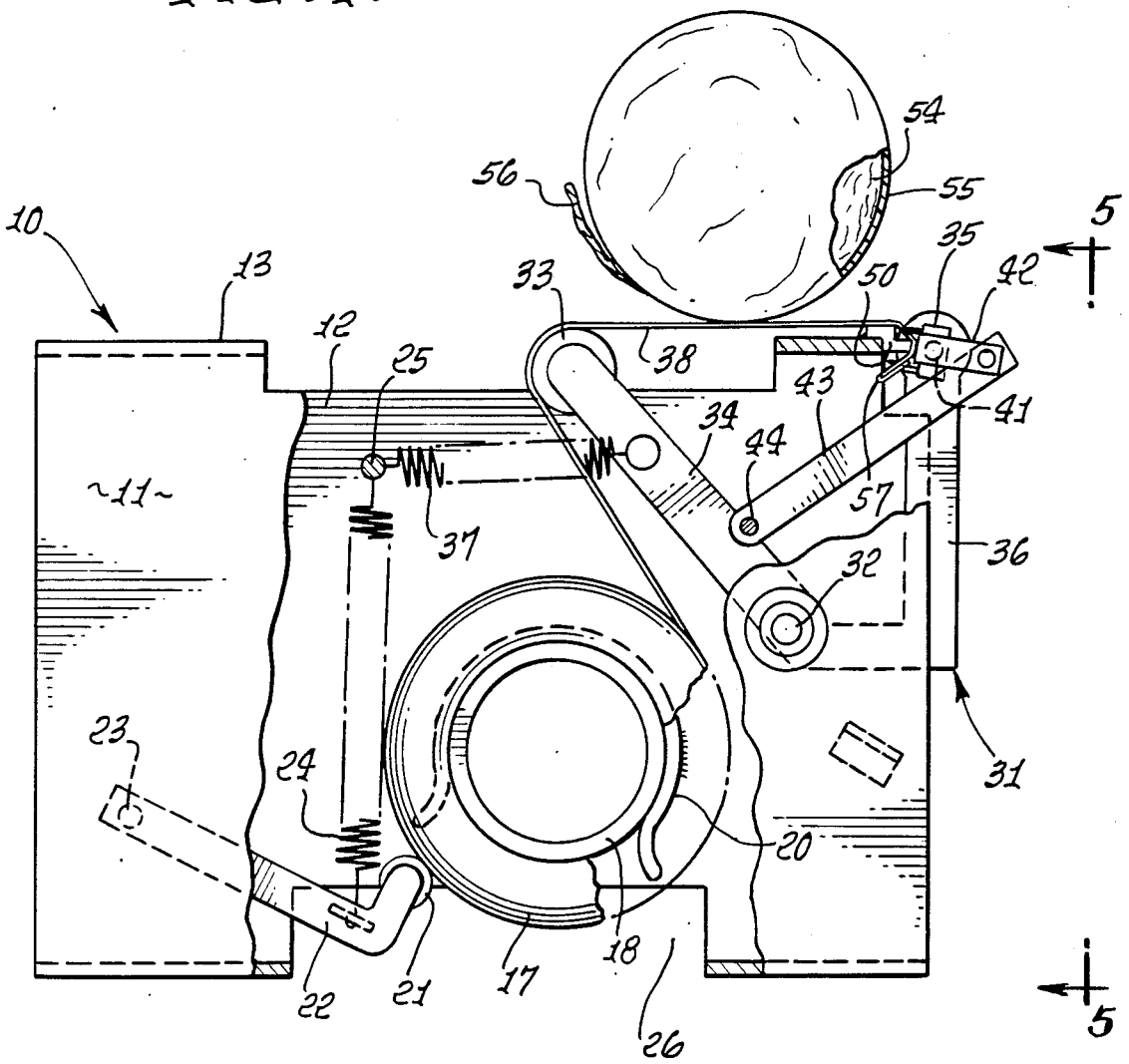
FIG. 1 is a side view of a tape dispenser incorporating the presently preferred embodiment of the invention and showing the device in the rest or start position.

The presently preferred embodiment of the invention as illustrated in the drawing figures includes a frame 10 having sides 11, 12, a top 13 and a bottom 14. Typically the frame may be made of a length of a box beam, but other frame constructions may be utilized as desired. Means are provided in the frame for supporting a roll of tape 17 mounted on a spool 18. In the embodiment illustrated, two arcuate shoulders 19, 20 are fixed to the inner walls of the sides 11, 12 for receiving the spool 18, with the shoulders spaced from each other permitting the roll of tape 17 to project between the shoulders. The spool 18 is urged upward against the shoulders 19, 20 by a roller 21 carried on a lever 22 which pivots in the frame on a pin 23. A spring 24 is connected between the lever 22 and another pin 25 carried in the frame. An opening 26 is provided in the bottom 14 of the frame for removal of an empty tape spool and insertion of a fresh tape spool.

A lever unit 31 with fixed arms 34 and 36 is pivotally mounted in the frame on a shaft 32. A roller 33 is carried on one arm 34 of the lever unit, and a cutter head 35 is carried on the other arm 36 of the lever unit. The arm 34 typically comprises two spaced arms with the roller 33 mounted therebetween. Similarly the arm 36 typically comprises two spaced arms with the cutter 35 mounted therebetween. A spring 37 is connected between the arm 34 and the pin 25 for urging the lever unit in the counterclockwise direction as viewed in FIGS. 1–4. The tape 38 from the spool 17 passes over the roller 33, with the roller serving as a support for the tape. While a roller is perferred for ease of operation, a smooth fixed surface may be utilized as the tape support is desired.

Figure 7:
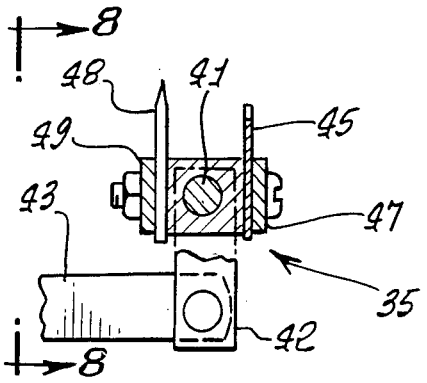
FIG. 7 is an enlarged side view of the cutter head of the tape dispenser of FIG. 1.
Figure 8:
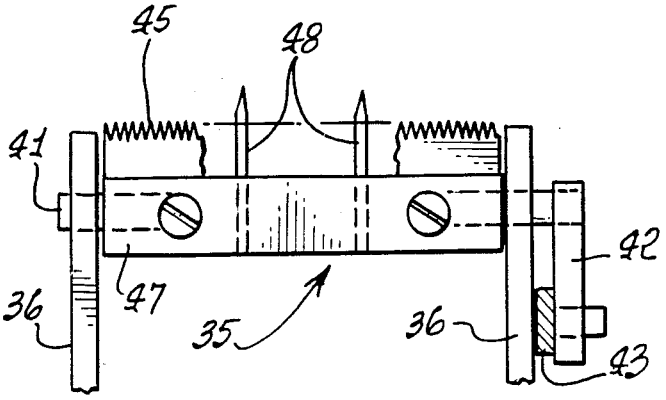
FIG. 8 is an end view of the cutter head of FIG. 7.
Figure 4:
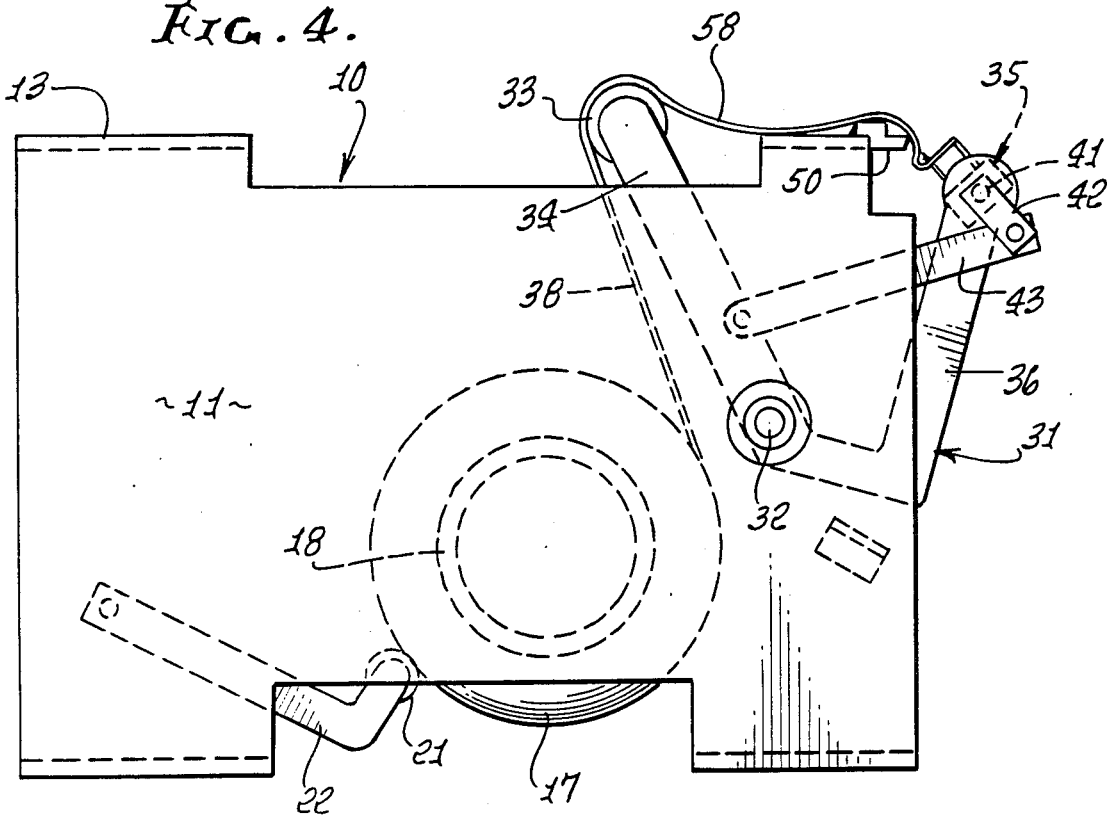
FIG. 4 is a view similar to that of FIGS. 1–3 showing the device in the tape folding condition.
Figure 5:
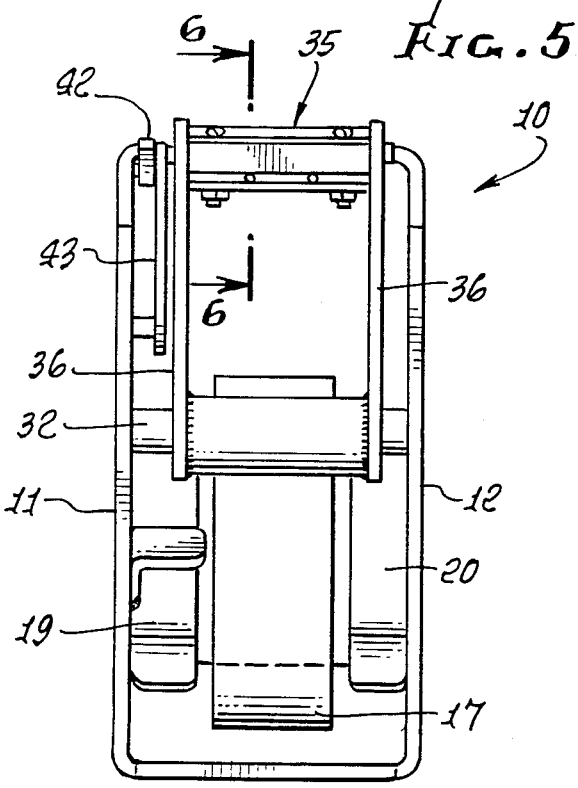
FIG. 5 is an end view of the device of FIG. 1, taken along the line 5—5 of FIG. 1.
Figure 6:
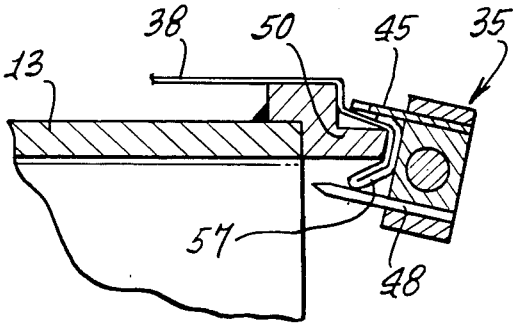
FIG. 6 is an enlarged partial sectional view of the device of FIG. 1, taken along the line 6—6 of FIG. 5.

The cutter head 35 is shown in greater detail in FIGS. 7 and 8. The cutter head is pivotally mounted on a shaft 41 in the arm 36 of the lever unit. A crank arm 42 is attached to the shaft 41 at one end, with the other end coupled to a link 43 which is pivotally mounted to the frame by a pin 44. In the preferred embodiment illustrated, a cutter plate 45 with a serrated or tooth-like edge is carried on the cutter head by another plate 47 attached by screws. Spaced pins 48 are also carried on the cutter head, being clamped by another plate 49 also attached by screws. The serrated cutter plate 45 functions in the conventional manner to sever the tape. The pins 48 function as tape engaging means for engaging the tape when the tape is pulled down across the cutter head. That is, the pins 48 function to engage the newly created free end of the tape when the tape is severed at the cutter head. The top 13 of the frame provides a work surface and typically has a horizontally projecting rib 50 which engages the cutter head 35 between the cutter plate 45 and the pins 48 in a manner to prevent the tooth-like edge being exposed in the rest or inoperative position (FIG. 6).

The operation of the tape dispenser of the invention will be described in conjunction with the taping of a head of lettuce 54 which has been placed in a plastic bag 55 having a twist closure 56. Of course, the method and apparatus of the invention are equally suitable for taping other products.

The apparatus is shown in the start or rest position in FIG. 1, with the tape 38 resting on the top 13 of the frame. The spool of tape is positioned in the frame so that the adhesive side of the tape is up away from the various components of the device. A tab 57 is formed at the free end of the tape by folding the free end back on itself in a manner to be described.

The operator places the bagged product down onto the adhesive side of the tape as shown in FIG. 1. The operator then rolls the product counterclockwise as seen in FIG. 1 and pulls the product to the right thereby wrapping the tape around the product. The partially wrapped product is shown in FIG. 2.

The pulling force applied by the operator in rolling the tape onto the product peels the tape from the roll 17 and also applies a force to the lever arm at the roller 33 which causes the lever unit to pivot clockwise to the position shown in FIG. 2 with the lever unit engaging the stop 39. As the lever unit 31 is rotated clockwise, the link 43 by being coupled to one end of the crank arm 42 causes the cutter head to rotate clockwise in the end of the arm 36. The cutter head rotates from the position shown in FIG. 1 to the position shown in FIG. 2.

When the tape is wrapped around the product to the degree desired, the operator pulls the tape down across the cutter head as shown in FIG. 3 and the tape on the product is severed from the remainder of the tape. The product is now taped, with the tab 57 free from adhesive contact with the product. As the tape is pulled down on the cutter head to sever the tape, the tape also engages the pins 48 which retain the newly created free end of the tape.

When the tape is severed, the pulling force which has extended the spring 37, is removed and the spring 37 rotates the lever unit 31 counterclockwise. As the lever unit rotates counterclockwise, the cutter head 35 is pivoted counterclockwise in the arm 36 by the link 43, producing a downward bow at 58 in the tape. See FIG. 4. While a spring is preferred to provide the restoring force, other means, such as a counterweight, can be used if desired.

The lever unit continues to rotate counterclockwise until the motion is stopped by engagement with a stop, typically engagement of the cutter head with the rib 50. By this time, the severed end of the bowed section 58 has been folded by the pins 48 and the cutter plate 45 to form the tab 57 (FIG. 6) and the device is now in the condition of FIG. 1 ready for taping another product. While the taping operation has been described as a series of discrete steps, the method and apparatus are such that the operator may tape the product and have the dispenser reset with a formed tab for taping another product in a single operator motion. The product is picked up from a container and moved downward to engage the upwardly facing adhesive, rolled away from the operator while being pulled toward the operator to tape the product, pulled downward to sever the tape, and placed in another container. Thus, it is seen that the desired taping is accomplished simply and easily and the desired free tab is formed without any separate operation by the operator.

We claim:

1. In a tape dispenser, the combination of:

a frame;

first tape support means mounted on said frame for supporting a roll of adhesive tape;

a lever unit containing two arms in fixed spaced apart relationship pivotally mounted on said frame for movement between a rest position and a tape cutting position, said lever unit having a cutter head mounted on one of said arms and a second tape support means positioned on the other of said arms, with said second tape support means disposed between said cutter head and said first tape support means so that an adhesive tape moves along a path from said first tape support means over said second tape support means to said cutter head with the adhesive side of the tape exposed away from said second tape support means, and with said cutter head having tape engaging means and pivoting between a tab forming position in which the adhesive side of the tape is folded back upon itself and a tape cutting position; and cutter head pivoting means in operative engagement with said lever unit for pivoting said cutter head from said tab forming position to said cutting position as said lever unit pivots from said rest position to said tape cutting position, and pivoting said cutter head from said tape cutting position to said tab forming position as said lever unit pivots from said tape cutting position to said rest position.

2. A taping dispenser as described in claim 1, wherein said tape engaging means includes a tape cutting plate and pin means for engaging the tape during tape cutting and folding the newly cut tape end onto itself to form a tab as said lever unit moves from said tape cutting position to said rest position.

3. In a tape dispenser, the combination of:

a frame;

first tape support means mounted on said frame for supporting a roll of adhesive tape;

a lever unit pivotally mounted on said frame for movement between a rest position and a tape cutting position;

a cutter head pivotally mounted on said lever unit for movement between a tab forming position and a tape cutting position;

second tape support means positioned between said first tape support means and said cutter head so that an adhesive tape moves from the first tape support means, over the second tape support means to the cutter head with the adhesive side of the tape exposed away from the second support means;

means responsive to the movement of tape over the second tape support means for moving the lever unit from the rest position to the tape cutting position;

return means in engagement with said lever unit yieldably urging said lever unit toward the rest position;

means responsive to the movement of the lever unit from the rest position to the tape cutting position for pivoting the cutter head from the tab forming position to the tape cutting position; and tape engaging means on said cutter head including a cutting blade for severing the tape when the cutter head is in the tape cutting position to provide a tape end, said tape engaging means folding said tape end back upon itself on the adhesive side to form a tab following the providing of the tape end and during the subsequent movement of the lever unit from the tape cutting position to the rest position.

4. A tape dispenser as described in claim 3, further including stop means on said frame limiting the movement of the lever unit to the tape cutting position.

5. A tape dispenser as described in claim 3, wherein said tape engaging means further includes pin means for engagement with the tape accompanying severing of the tape to provide a tape end.

6. A tape dispenser as described in claim 5, wherein said pin means is formed and arranged to pierce and retain the tape end in position on the cutter head following the severing of the tape.

7. A tape dispenser as described in claim 3, further including rib means on the frame limiting the movement of the lever unit to the rest position and coacting with the tape engaging means to complete the formation of said tab.

8. A tape dispenser as described in claim 3, further including rib means on the frame coacting with the tape engaging means to releasably maintain said tab in engagement with the cutter head following formation of the tab and when the lever unit is in the rest position.

9. A tape dispenser as described in claim 3, wherein said tape engaging means further includes pin means in spaced apart relationship with said cutting blade for holding engagement with said tape following the severing of the tape and during the formation of said tab.

10. A tape dispenser as described in claim 9, further including rib means on the frame received between said cutting blade and said pin means when the lever unit is in the rest position.

11. A tape dispenser as described in claim 10, wherein said rib means includes a shoulder which is engaged by the cutting blade when the lever unit is in the rest position, to shield said cutting blade.

* * * * *